US007708263B2

(12) United States Patent
Yano et al.

(10) Patent No.: US 7,708,263 B2
(45) Date of Patent: May 4, 2010

(54) IMAGE FORMING APPARATUS

(75) Inventors: Hidetoshi Yano, Tokai (JP); Atsushi Miwa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 507 days.

(21) Appl. No.: 11/430,157

(22) Filed: May 9, 2006

(65) Prior Publication Data

US 2006/0267269 A1 Nov. 30, 2006

(30) Foreign Application Priority Data

May 11, 2005 (JP) ..... 2005-138824

(51) Int. Cl.
*B65H 3/44* (2006.01)

(52) U.S. Cl. ..... 271/9.09; 271/9.13

(58) Field of Classification Search ..... 271/9.09, 271/9.13, 9.01
See application file for complete search history.

(56) References Cited

U.S. PATENT DOCUMENTS

| | | | | |
|---|---|---|---|---|
| 4,925,062 | A | 5/1990 | Tsukamoto et al. | |
| 5,104,111 | A * | 4/1992 | Matsuda | 271/110 |
| 5,123,637 | A * | 6/1992 | Musaka | 271/117 |
| 5,201,873 | A * | 4/1993 | Kikuchi et al. | 271/9.13 |
| 5,347,350 | A * | 9/1994 | Nakahata et al. | 399/23 |
| 5,870,654 | A * | 2/1999 | Sato et al. | 399/109 |
| 6,055,410 | A * | 4/2000 | Marumoto et al. | 399/392 |
| 6,438,351 | B2 * | 8/2002 | Kawachi et al. | 399/394 |
| 6,554,270 | B2 | 4/2003 | Yamamoto | |
| 6,836,624 | B2 * | 12/2004 | Suzuki | 399/44 |
| 7,036,813 | B2 * | 5/2006 | Asada | 271/117 |
| 7,149,455 | B2 | 12/2006 | Hattori | |
| 7,156,389 | B2 * | 1/2007 | Kadowaki et al. | 271/118 |
| 2003/0090053 | A1 * | 5/2003 | Hsiao et al. | 271/118 |

(Continued)

FOREIGN PATENT DOCUMENTS

| | | |
|---|---|---|
| JP | 62-133552 | 8/1987 |

(Continued)

OTHER PUBLICATIONS

Japanese Office Action, with English translation, issued in Japanese Patent Application No. JP 2005-138824, mailed Jan. 29, 2008.

*Primary Examiner*—Patrick H Mackey
*Assistant Examiner*—Michael C McCullough
(74) *Attorney, Agent, or Firm*—McDermott Will & Emery LLP

(57) ABSTRACT

An image forming apparatus that includes: a housing that has a sheet member feed-in port on a side of one side surface thereof; a feed-in mechanism disposed in a second conveyance passage to feed the sheet member from the sheet member feed-in port to a side of a junction point between a first conveyance passage and the second conveyance passage. The feed-in mechanism includes: a feed-in roller that feeds the sheet member into the sheet member feed-in port; a separation member disposed on a downstream side in a conveyance direction of the sheet member with respect to the feed-in roller; and a separation roller. An opposition position between the separation member and the separation roller is located further from the one side surface than the first conveyance passage and is located closer to the one side surface than the junction point.

14 Claims, 12 Drawing Sheets

U.S. PATENT DOCUMENTS

| | | | | |
|---|---|---|---|---|
| 2005/0019073 | A1 | 1/2005 | Hattori | |
| 2005/0073087 | A1* | 4/2005 | Kadowaki et al. | 271/118 |
| 2005/0254873 | A1* | 11/2005 | Murakami et al. | 400/55 |
| 2006/0049572 | A1* | 3/2006 | Miyazawa | 271/121 |
| 2006/0056862 | A1* | 3/2006 | Fujita | 399/16 |
| 2006/0082044 | A1* | 4/2006 | Aida | 271/145 |
| 2007/0222136 | A1* | 9/2007 | Murakami | 271/9.09 |

FOREIGN PATENT DOCUMENTS

| | | |
|---|---|---|
| JP | 1-70726 | 5/1989 |
| JP | 2000-168992 | 6/2000 |
| JP | 2001-80774 | 3/2001 |
| JP | 2001-130761 | 5/2001 |
| JP | 2001-225965 | 8/2001 |
| JP | 2002-37541 | 2/2002 |
| JP | 2003-34446 | 2/2003 |
| JP | 2003-201035 | 7/2003 |
| JP | 2005-41652 | 2/2005 |

* cited by examiner

IMAGE FORMING APPARATUS

CROSS REFERENCE TO RELATED APPLICATION

This application claims priority from Japanese Patent Application No. 2005-138824, filed on May 11, 2005, the entire subject matter of which is incorporated herein by reference.

TECHNICAL FIELD

Aspects of the present invention relate to an image forming apparatus that has a sheet member feed-in port on one side surface.

BACKGROUND

JP-A-2005-41652 discloses an apparatus in which a multipurpose tray 14 for hand insertion and a multipurpose feed mechanism unit 15 for feeding paper sheets on the multipurpose tray 14 and separating them one by one are disposed on a side surface of a laser printer 1. The apparatus has a configuration wherein the paper sheets on the multipurpose tray 14 are fed and separated by one multipurpose feed roller 15*a* that is pressed against a multipurpose pad member 15*d*.

SUMMARY

In the configuration disclosed in JP-A-2005-41652, the paper feed and the separation are performed by the multipurpose feed roller 15*a*. Thus, the outer peripheral surface of this multipurpose feed roller 15*a* needs to abut on the paper sheets on the multipurpose tray 14 and needs to be pressed against the multipurpose pad member 15*d*. Accordingly, the multipurpose feed roller 15*a* inevitably needs to have a large diameter. Moreover, the multipurpose feed roller 15*a* needs to be arranged on the side close to the multipurpose tray so that the roller 15*a* abuts on the paper sheets on the multipurpose tray 14. Therefore the size of the whole laser printer 1 is enlarged in the horizontal direction and vertical direction.

Aspects of the invention provide an image forming apparatus that realizes reduction in the size of the image forming apparatus in, at least, the horizontal direction thereof while including a mechanism for feeding in a sheet member from a sheet member feed-in port.

According to an aspect of the invention, there is provided an image forming apparatus including: a housing that has a sheet member feed-in port, on a side of one side surface thereof, for feeding in a sheet member; a loading tray on which the sheet member to be fed into the sheet member feed-in port is loaded; a sheet member accommodation cassette that is arranged on a bottom side of the housing, a sheet member is accommodated in the sheet member accommodation cassette; a first conveyance passage formed within the housing, the sheet member accommodated in the sheet member accommodation cassette is conveyed in the first conveyance passage while being folded back from the side of the one side surface of the housing to an opposite side; a second conveyance passage extending from the sheet member feed-in port to a downstream end side of the first conveyance passage; a feed-in mechanism disposed in the second conveyance passage, the feed-in mechanism feeding the sheet member from the sheet member feed-in port to a side of a junction point between the first conveyance passage and the second conveyance passage; and a process unit that forms an image on the sheet member passed through the junction point, the process unit disposed on a downstream side in a conveyance direction of the sheet member with respect to the junction point; wherein the feed-in mechanism includes: a feed-in roller that feeds the sheet member loaded on the loading tray into the sheet member feed-in port; a separation member disposed on a downstream side in the conveyance direction of the sheet member with respect to the feed-in roller; and a separation roller that opposes to the separation member and delivers the sheet member to the side of the junction point; and wherein an opposition position between the separation member and the separation roller is located further from the one side surface than a part of the first conveyance passage and is located closer to the one side surface than the junction point.

Incidentally, the "image forming apparatus" is not limited to a printing apparatus such as printer (for example, laser printer), but it may well be a facsimile equipment or a multi function apparatus having a printer function, a scanner function, etc.

The "sheet member" includes a paper sheet, an OHP sheet, etc., as a recording member.

In the configuration, the feed-in mechanism which feeds in the sheet members on the loading tray and separates them one by one has been formed as a twin-roller type that includes the feed-in roller and the separation roller. Thus, each of the rollers can be made smaller in diameter than the multipurpose feed roller in the configuration of JP-A-2005-41652. Besides, the opposition position between the separation roller of small diameter and the separation member can be located on the further side of that U-shaped first conveyance passage which is nearest to one side surface of the housing, as viewed from the side of the side surface. On the other hand, on the side of the loading tray, the feed-in roller of small diameter abutting on the loaded paper sheets can be arranged. Accordingly, while the mechanism for feeding in the sheet members from the sheet member feed-in port is included, the size of the image forming apparatus in, at least, the horizontal direction thereof can be reduced.

DETAILED DESCRIPTION

An aspect of the present invention will be described with reference to FIGS. 1 to 12.

1. General Configuration

Figure 1:
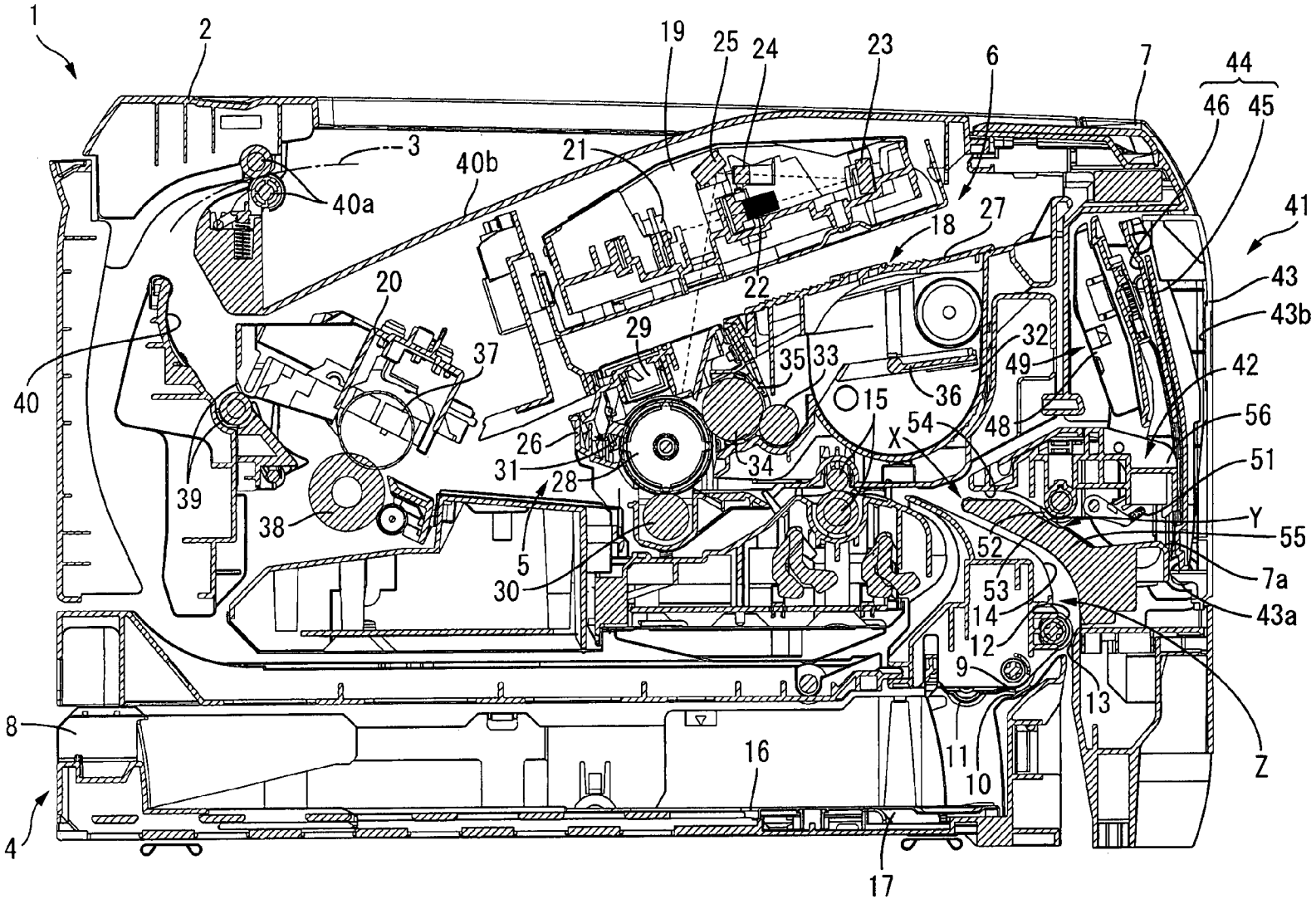
FIG. 1 is a side sectional view of a laser printer according to an aspect of the present invention.

FIG. 1 is a side sectional view of a laser printer according to an aspect of an image forming apparatus. The laser printer 1 includes a feeder section 4, which serves to feed a paper sheet 3 (a sheet member) that is a recording medium, and an image formation section 5 which serves to form an image on the fed paper sheet 3, within a body casing 2 (a housing).

(1) Body Casing

An attachment/detachment opening 6 for attaching and detaching a process cartridge 18, described later, is formed in a side wall on one side (one side surface) of the body casing 2. The body casing 2 is provided with a front cover 7 for opening and closing the attachment/detachment opening 6.

The front cover 7 is rotatably supported by a cover shaft, not shown, which is inserted through the lower end part thereof. Thus, when the front cover 7 is closed about the cover shaft, the attachment/detachment opening 6 is closed by the front cover 7 as shown in FIG. 1. When the front cover 7 is opened or inclined with the cover shaft as a fulcrum, the attachment/detachment opening 6 is opened, and the process cartridge 18 can be attached to and detached from the body casing 2 through the attachment/detachment opening 6.

Incidentally, regarding the laser printer 1 and the process cartridge 18 that includes a development cartridge 27, described later, a side on which the front cover 7 is provided is referred to as a "front side", and the opposite side is referred to as a "rear side". Besides, a right side (far side of FIG. 1) of the laser printer 1 viewed from its front surface side is referred to as a "right side", and the opposite side (near side of FIG. 1) is referred to as a "left side".

(2) Feeder Section

The feeder section 4 includes a feed tray 8 (sheet member accommodation cassette), which is detachably mounted at a bottom part of the body casing 2, and a separation roller 9 and a separation pad 10, which are disposed over the front end part of the feed tray 8. The feeder section 4 further includes a feed roller 11, which is disposed on the rear side of the separation roller 9 (on the upstream side of the conveyance direction of the paper sheet 3 with respect to the separation pad 10).

The feeder section 4 is provided with a paper dust removal roller 12, which is arranged above the front side of the separation roller 9 (on the downstream side of the conveyance direction of the paper sheet 3 with respect to the separation roller). An opposition roller 13 is arranged in opposition to the paper dust removal roller 12. In addition, a first conveyance path 14 (a first conveyance passage) of the paper sheet 3 has a shape in which the paper sheet 3 is folded back rearwards in the shape of letter U from near the arrangement position of the paper dust removal roller 12. On the further downstream side of the conveyance direction, registration rollers 15 and 15 being a pair of rollers are arranged under the process cartridge 18.

A sheet urging plate 16 on which the paper sheets 3 can be placed in stacked fashion is included inside the feed tray 8. The sheet urging plate 16 is swingably supported at its rear end part, whereby its front end part is movable in up and down directions.

A lever 17 for lifting the front end part of the sheet urging plate 16 upwards is disposed at the front end part of the feed tray 8. The lever 17 has its rear end part swingably supported by a lever shaft, not shown, at a position under the front end part of the sheet urging plate 16, and its front end part abuts against the front end part of the lower surface of the sheet urging plate 16. Thus, when a rotational drive force, which is counterclockwise as viewed in the figure, is inputted to the lever shaft, the lever 17 is rotated with a fulcrum at the lever shaft, and the front end part of the lever 17 lifts up the front end part of the sheet urging plate 16.

When the front end part of the sheet urging plate 16 is lifted up, the uppermost ones of the paper sheets 3 on the sheet urging plate 16 are pressed by the feed roller 11, and they begin to be fed toward the separation position between the separation roller 9 and the separation pad 10, by the rotation of the feed roller 11.

On the other hand, when the feed tray 8 is detached from the body casing 2, the rotational drive force input is released, and the front end part of the sheet urging plate 16 moves down by the weight of this front end part itself so as to assume a state where the sheet urging plate 16 extends along the bottom surface of the feed tray 8. In this state, the paper sheets 3 can be placed on the sheet urging plate 16 in the stacked fashion.

When interposed between the separation roller 9 and the separation pad 10 by the rotation of this separation roller 9, the paper sheets 3 delivered toward the separation position by the feed roller 11 are reliably separated one by one and are fed. The fed paper sheet 3 is folded back along the first conveyance path 14, which is U-shaped. Specifically, the fed paper sheet 3 is first conveyed frontward and then obliquely upwards by the separation roller 9 and the separation pad 10. The paper sheet 3 further passes through between the paper dust removal roller 12 and the opposition roller 13, thereby the paper dust is removed. The paper sheet 3 is thereafter conveyed to the registration rollers 15.

The registration rollers 15 are configured as a pair of rollers opposing to each other. After registration of the paper sheet 3, the registration rollers 15 convey this paper sheet 3 toward a transfer position of the image formation section 5. The transfer position is the nip position between a photosensitive drum 28 and a transfer roller 30, described later. A toner image on the photosensitive drum 28 is transferred onto the paper sheet 3 at this transfer position.

(3) Image Formation Section

The image formation section 5 includes a scanner unit 19, the process cartridge 18, a fixing unit 20, etc.

(a) Scanner Unit

The scanner unit 19 is disposed at an upper part within the body casing 2. The scanner unit 19 includes a laser light source (not shown), a polygon mirror 21 which is driven to rotate, an fθ lens 22, a reflector 23, a lens 24, a reflector 25, etc. As indicated by broken lines in FIG. 1, a laser beam based on image data emitted from the laser light source is deflected by the polygon mirror 21 and is passed through the fθ lens 22. Thereafter, the laser beam is folded back rearwards by the reflector 23 and is further passed through the lens 24. Thereafter, the laser beam is bent rearwards and obliquely downwards by the reflector 25. In this way, the laser beam is projected onto the surface of the photosensitive drum 28 of the process cartridge 18 by fast scan.

(b) Process Cartridge

The process cartridge 18 is detachably attached to the body casing 2 under the scanner unit 19. This process cartridge 18 includes a drum cartridge 26 and a development cartridge 27 that is detachably mounted on the drum cartridge 26.

The drum cartridge 26 has the development cartridge 27 mounted on its front side. The drum cartridge 26 includes on the rear side thereof the photosensitive drum 28, a scolotron type electric charger 29, the transfer roller 30 and a cleaning brush 31.

Among these constituents, the scolotron type charger 29 is arranged in opposition to the photosensitive drum 28 with a predetermined spacing between the charger 29 and drum 28. The charger 29 can uniformly charge the surface of the photosensitive drum 28 to the positive polarity.

The development cartridge 27 is provided with a toner accommodation chamber 32 in which a toner is accommodated, a supply roller 33, a development roller 34 and a layer thickness regulation blade 35.

The toner within the toner accommodation chamber 32 is supplied toward the supply roller 33 by an agitator 36, which is driven to rotate, and is supplied to the development roller 34 by the rotation of the supply roller 33. On this occasion, the toner is frictionally charged positively between the supply roller 33 and the development roller 34. The toner supplied onto the development roller 34 advances into the interspace between the layer thickness regulation blade 35 and the development roller 34, in accordance with the rotation of this development roller 34. The toner is then carried on the development roller 34 in the form of a thin layer of predetermined thickness.

As the photosensitive drum 28 is rotated, the surface thereof is first positively charged uniformly by the scolotron type charger 29. Thereafter, the surface of the photosensitive drum 28 is exposed to light by the fast scan with the laser beam from the scanner unit 19. Thus, the surface of the photosensitive drum 28 is formed with an electrostatic latent image, which corresponds to an image to be formed on the paper sheet 3.

Subsequently, when the toner carried on the development roller 34 and charged positively is opposed and touched to the photosensitive drum 28 by the rotation of the development roller 34, the toner is supplied to the electrostatic latent image, which has been formed on the surface of the photosensitive drum 28. In other words, the toner is supplied to an exposed part, which has been exposed to the light by the laser beam and whose potential is lower, in the surface of the photosensitive drum 28 positively charged uniformly. Thus, the electrostatic latent image of the photosensitive drum 28 is turned into a visible image, and the toner image based on a reversal development is carried on the surface of the photosensitive drum 28.

Thereafter, the toner image carried on the surface of the photosensitive drum 28 is transferred onto the paper sheet 3 by a transfer bias applied to the transfer roller 30, while the paper sheet 3 conveyed by the registration rollers 15 passes through the transfer position between the photosensitive drum 28 and the transfer roller 30 as shown in FIG. 1. The paper sheet 3 on which the toner image has been transferred is conveyed to the fixing unit 20. Incidentally, a transfer remainder toner, which remains on the photosensitive drum 28 after the transfer, is recovered onto the development roller 34. Besides, paper dust that adheres on the photosensitive drum 28 from the paper sheet 3 is collected by the cleaning brush 31 after the transfer.

(c) Fixing Unit

The fixing unit 20 is disposed on the rear side of the process cartridge 18. The fixing unit 20 includes a heating roller 37 and a pressing roller 38.

The heating roller 37 includes a halogen lamp for heating. The heating roller 37 is driven and rotated by power inputted from a motor not shown. The pressing roller 38 is arranged in opposition to and below the heating roller 37 so as to press this heating roller 37. The pressing roller 38 is driven in accordance with the rotation of the heating roller 37.

The fixing unit 20 is disposed behind the process cartridge 18 and on the downstream side of the conveyance direction of the paper sheet 3. The fixing unit 20 includes the heating roller 37, the pressing roller 38 and a conveyance roller 39. The heating roller 38 has the halogen lamp as a heater provided in a tube made of metal. The pressing roller 38 is arranged in opposition to and below the heating roller 37 and is disposed so as to press the heating roller 37 from below. Besides, the conveyance roller 39 is disposed on the downstream side of the conveyance direction of the paper sheet 3 with respect to the heating roller 37 and the pressing roller 38.

The toner transferred on the paper sheet 3 is thermally molten and fixed onto the paper sheet 3 while this paper sheet 3 passes between the heating roller 37 and the pressing roller 38. The paper sheet 3 is guided by the conveyance roller 39 so as to be folded back in the shape of letter U by a guide portion 40, which is vertically arranged behind this conveyance roller 39. The paper sheet 3 is conveyed toward sheet discharge rollers 40*a*. Thereafter, the paper sheet 3 is discharged onto a sheet discharge tray 40*b* by the sheet discharge rollers 41.

2. Multipurpose Mechanism

Figure 2:
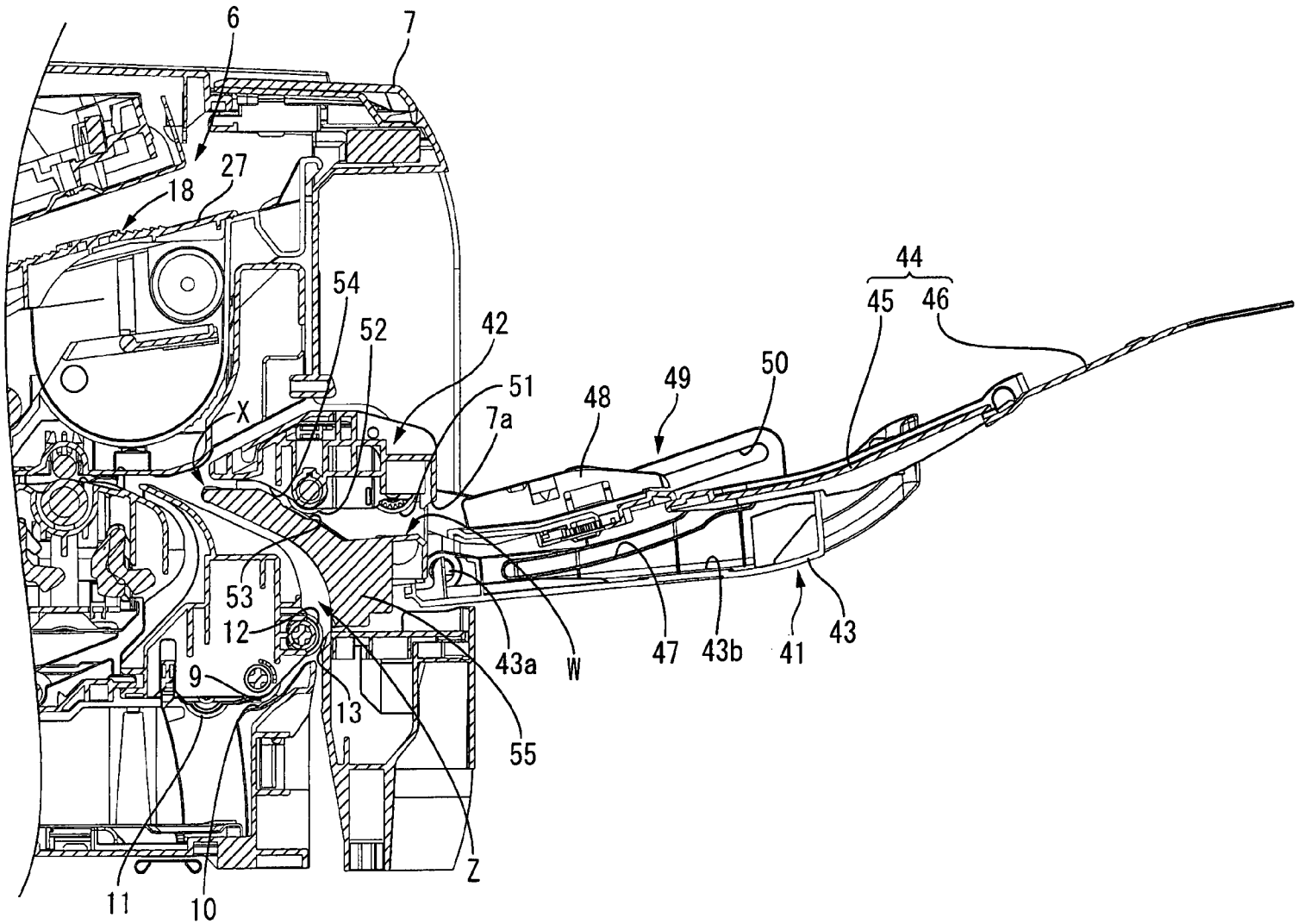
FIG. 2 is an enlarged side sectional view of the laser printer in the state where an MP tray is opened.

FIG. 2 is a side sectional view showing a state where a multipurpose tray (a loading tray), hereinafter referred to as an MP tray 41, is opened. In addition to the paper feed mechanism in which the paper sheet 3 is conveyed from the feed tray 8 to the transfer position through the first conveyance path 14, the laser printer 1 has a multipurpose mechanism (hand-insertion feed mechanism) in which a paper sheet is conveyed from the front surface side of the laser printer 1 to the transfer position by hand insertion.

In other words, the feeder section 4 includes the MP tray 41 and a multipurpose feed mechanism unit (a feed-in mechanism), hereinafter referred to as an MP feed mechanism unit 42, for feeding the paper sheet 3 on the MP tray 41.

(1) MP Tray

A rectangular opening 7*a* (a sheet member feed-in port) is penetratingly formed in the front cover 7, and the MP tray 41 is disposed so as to cover the rectangular opening 7*a*. The MP tray 41 includes a cover portion 43, which constitutes the front wall of the body casing 2, and a tray portion 44 on which the paper sheets 3 for the hand insertion are loaded. As shown in FIG. 2, a lower end side of the cover portion 43 is supported on the body casing 2 through a rotary shaft 43*a*. The cover portion 43 is openable and closable about the rotary shaft 43*a*. The cover portion 43 is held in a state where its inner surface part 43*b* faces up. The tray portion 44 is mounted on the inner surface part 43*b*.

The tray portion 44 includes a first tray plate 45, which is arranged on the inner surface part 43*b* of the cover portion 43, and a second tray plate 46, which is rotatably supported on a front end part of the first tray plate 45. The first tray plate 45 is located at a position at which it is received in the inner surface part 43*b* of the cover portion 43 in the closed state (refer to FIG. 1) of the MP tray 41. The first tray plate 45 is slidable to a position at which its front end part protrudes in front of the cover portion 43 along a guide groove 47, in the opened state (refer to FIG. 2) of the MP tray 41.

The second tray plate 46 is rotatably supported on the front end part of the first tray plate 45 and is rotatable between a position at which it is placed on the upper surface of the first tray plate 45 (refer to FIG. 1), and a position at which it is spread in front of the first tray plate 45 (refer to FIG. 2). By the way, in the opened state of the MP tray 41 as shown in FIG. 2, the tray portion 44 assumes an attitude in which the side of the rotary shaft 43*a* (the insertion distal-end side of the paper sheet 3) inclines downward.

The MP tray 41 is provided with a guide mechanism 49 having a pair of guide ribs 48 and 48 (only the left one of them is shown in FIG. 1 or FIG. 2) between which both the widthwise ends of the paper sheets 3 loaded on the tray portion 44 are held so as to guide the conveyance of the paper sheet 3 when this MP tray 41 is opened. The pair of guide ribs 48 and 48 are slidable between positions at which they come near to each other and positions at which they come away from each other, whereby the MP tray 41 can stack the paper sheets 3 of any desired size in the stacked fashion.

The guide mechanism 49 is disposed so as to lie behind the upper end part of the folded up tray portion 44 (in a space over the MP feed mechanism unit 42), in the closed state of the MP tray 41 (refer to FIG. 1). The guide mechanism 49 slides and moves along a guide groove 50 and lies on the rear end side of the first tray plate 45, in the opened state of the MP tray 41 (refer to FIG. 2).

(2) MP Paper Feed Mechanism Unit

As shown in FIG. 2, the MP feed mechanism unit 42 includes a multipurpose feed roller (feed-in roller), hereinafter referred to as an MP feed roller 51, a multipurpose separation roller, hereinafter referred to as an MP separation roller 52, and a multipurpose separation pad (separation member), hereinafter referred to as an MP separation pad 53. The MP separation pad 53 is opposed to and pressed against the MP separation roller 52. In a state where the MP separation roller 52 and the MP separation pad 53 touch in opposition to each other, the MP separation pad 53 is pressed against the MP separation roller 52 by the urging force of an urging member (not shown). That is, the multipurpose mechanism in this aspect is a twin-roller type in which the MP feed roller 51 and the MP separation roller 52 are provided. The multipurpose mechanism has a configuration in which the MP feed roller 51 is arranged on the side of the MP tray 41 and the separation roller 52 is arranged behind the MP feed roller 51.

The uppermost ones of the paper sheets 3 stacked on the MP tray 41 are fed by the rotation of the MP feed roller 51 and are held between the MP separation roller 52 and the MP separation pad 53, whereupon they are separated and fed one by one by the cooperation of these constituents 52 and 53. The fed paper sheet 3 passes through a second conveyance path 54 (a second conveyance passage). The paper sheet 3 advances from a junction point X near the downstream end of the first conveyance path 14 in the conveyance direction until it is fed to the side of the registration rollers 15.

More specifically, a partition member 55, which is held between the first conveyance path 14 and the second conveyance path 54, defines a side sectional shape extending along the U-shape of the first conveyance path 14. The partition member 55 is in a shape in which it inclines from the junction point X, being the highest position, downwards toward the front side thereof. In short, a space on the upper surface side of the partition member 55 is a downwardly inclining space that extends downwards from the junction point X toward the front side. Besides, a roller unit 56, in which the MP feed roller 51 and the MP separation roller 52 are supported by shafts in a state where they are exposed below, is disposed in the downwardly inclining space, and the MP feed roller 51 is moved up and down within the downwardly inclining space as will be stated later.

The MP separation pad 53 is arranged on the intermediate part of the inclining upper surface of the partition member 55. The MP separation roller 52 is arranged in opposition to the MP separation pad 53 from above, whereby both the constituents 52 and 53 are in the pressed state. More specifically, an opposition position Y, at which the MP separation roller 52 and the MP separation pad 53 oppose, lies on the rear side with respect to the frontmost part Z (a part nearest to one side surface) of the first conveyance path 14 and on the front side with respect to the junction point X. Moreover, the opposition position Y lies below the junction point X and above the frontmost part Z.

Figure 3:
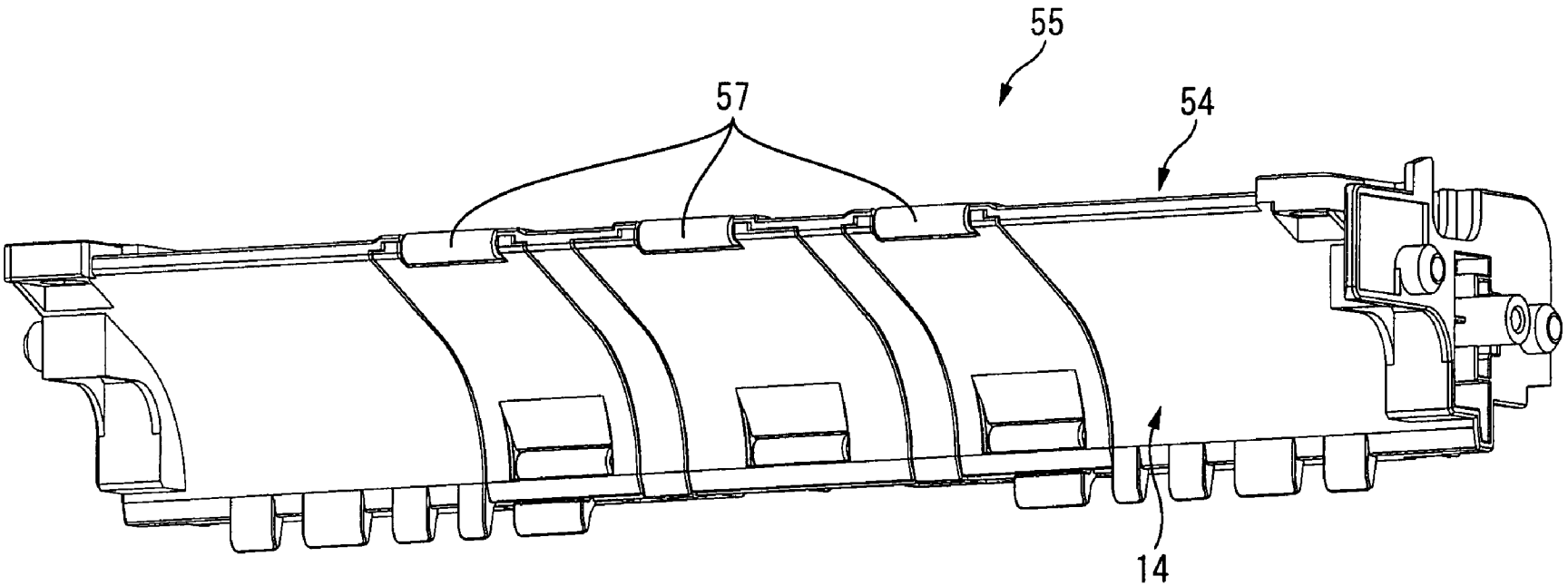
FIG. 3 is a perspective view of a partition member seen from the rear side thereof.

FIG. 3 is a perspective view of the partition member 55 seen from the rear side thereof. One or more (in this aspect, three) common rolls 57, which are arrayed in a right-and-left direction and are supported by shafts so as to be idly turnable, are provided at the uppermost end part of the partition member 55, namely, the position thereof corresponding to the junction point X. The common rolls 57 have their outer peripheral surfaces exposed so as to touch the paper sheet 3 conveyed from both the first conveyance path 14 and the second conveyance path 54 and to turn with the advance of the paper sheet 3.

(3) Vertical Movement Drive Mechanism of MP Feed Roller

Figure 4:
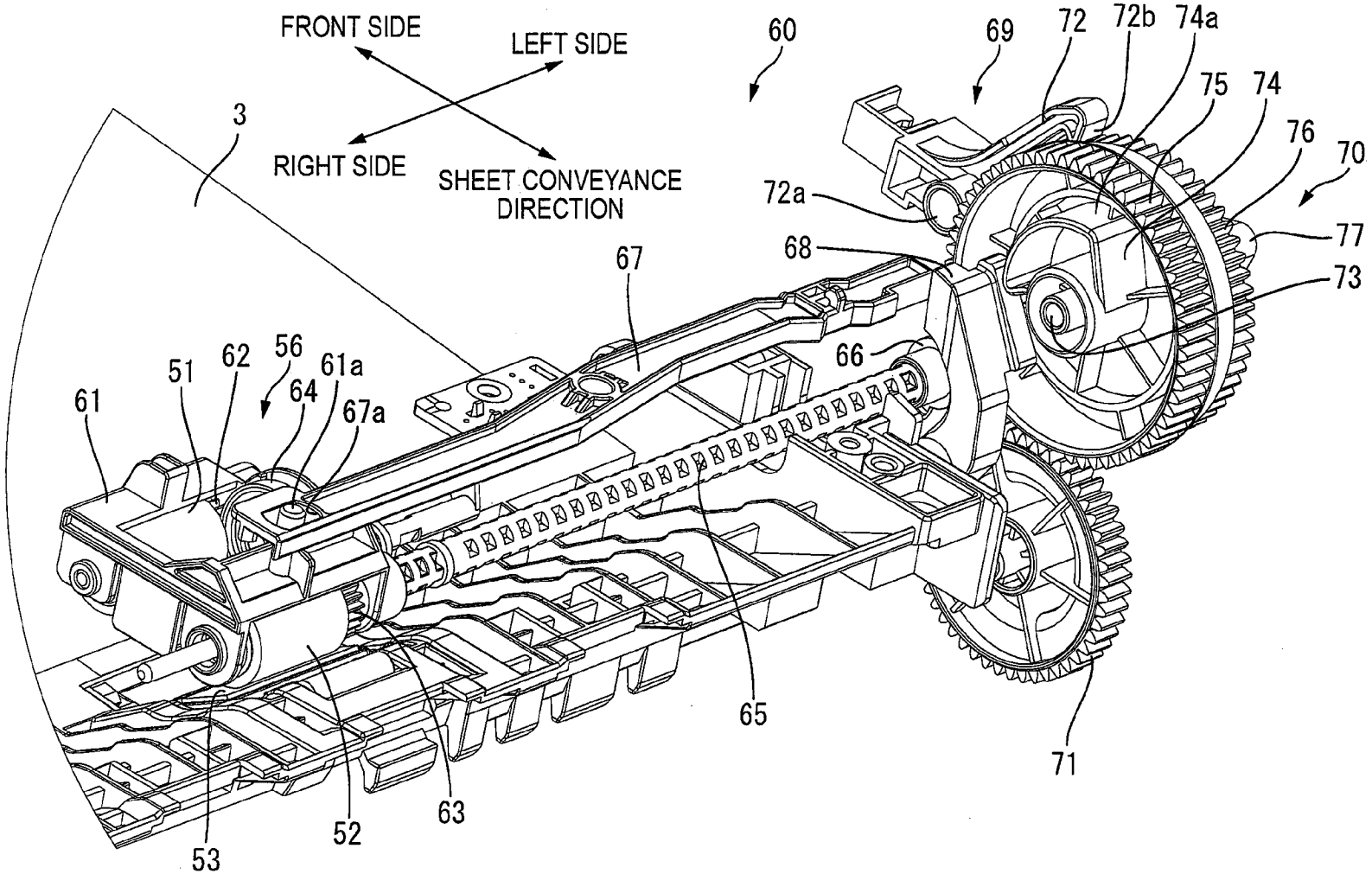
FIG. 4 is a perspective view showing a vertical movement drive mechanism of an MP feed roller (a state where the MP feed roller lies at the ascent position thereof)
Figure 5:
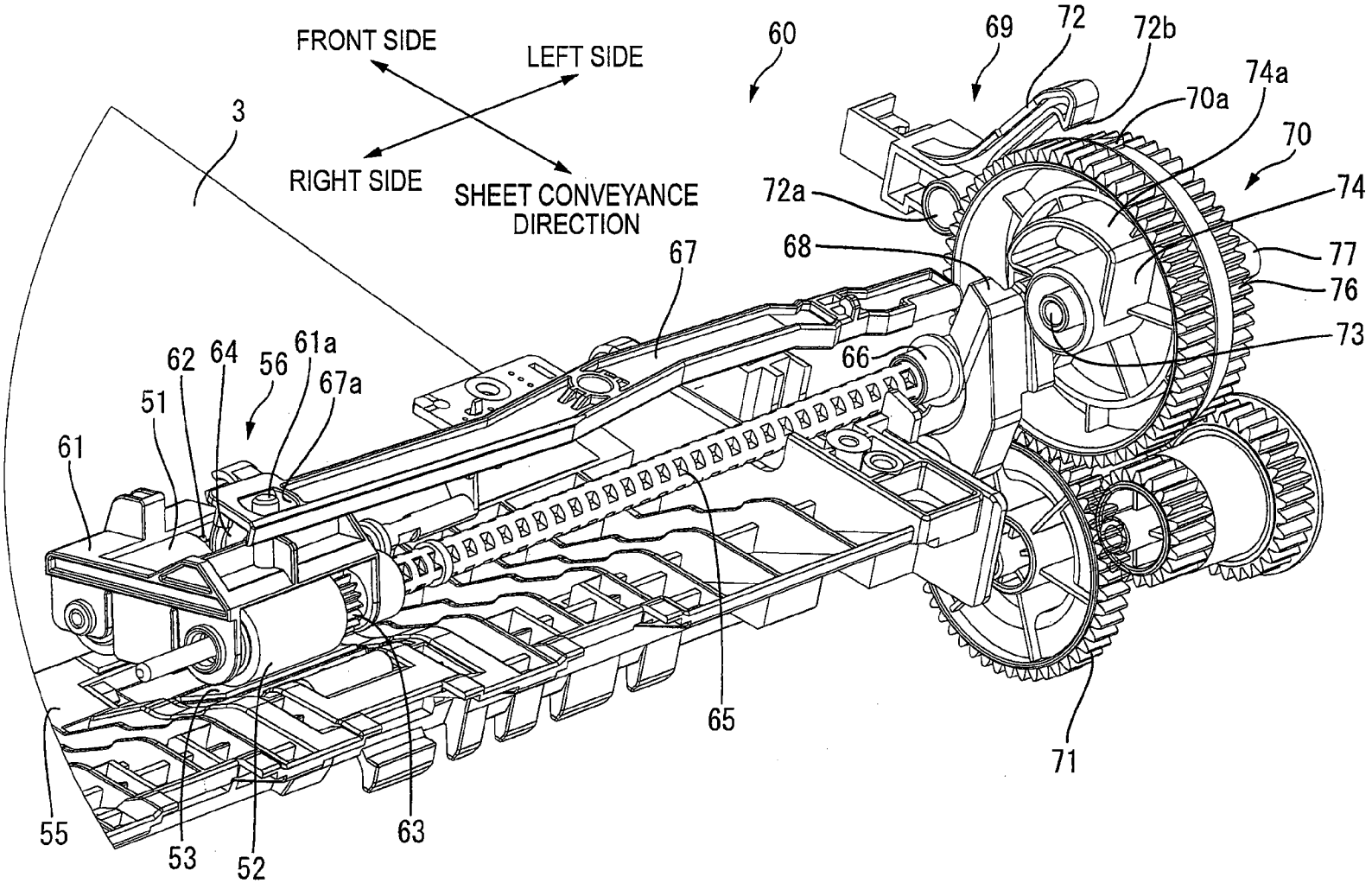
FIG. 5 is a perspective view showing the vertical movement drive mechanism of the MP feed roller (a state where the MP feed roller lies at the descent position thereof)
Figure 6:
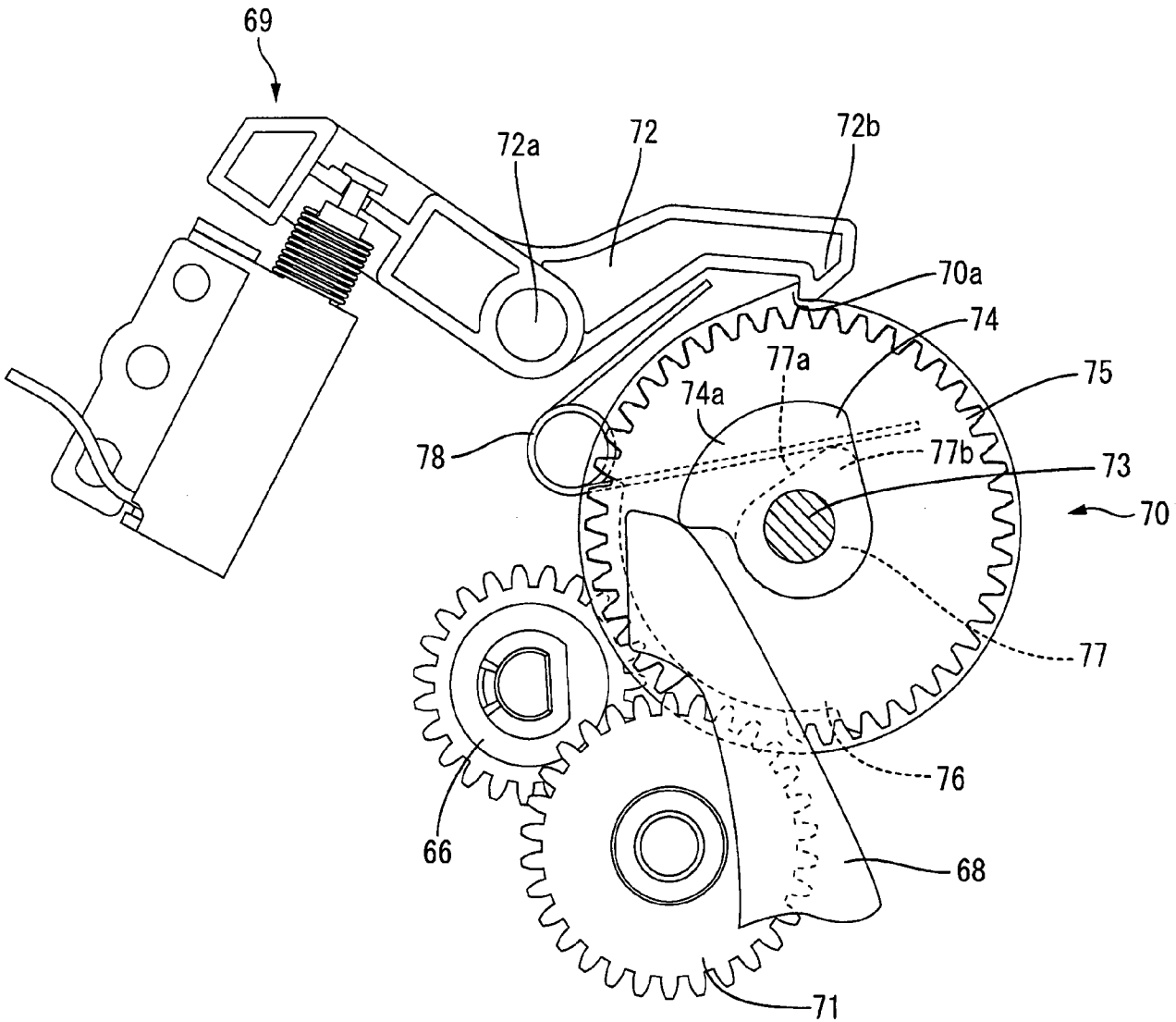
FIG. 6 is a side view of the vertical movement drive mechanism in the state where the MP feed roller lies at its ascent position.
Figure 7:
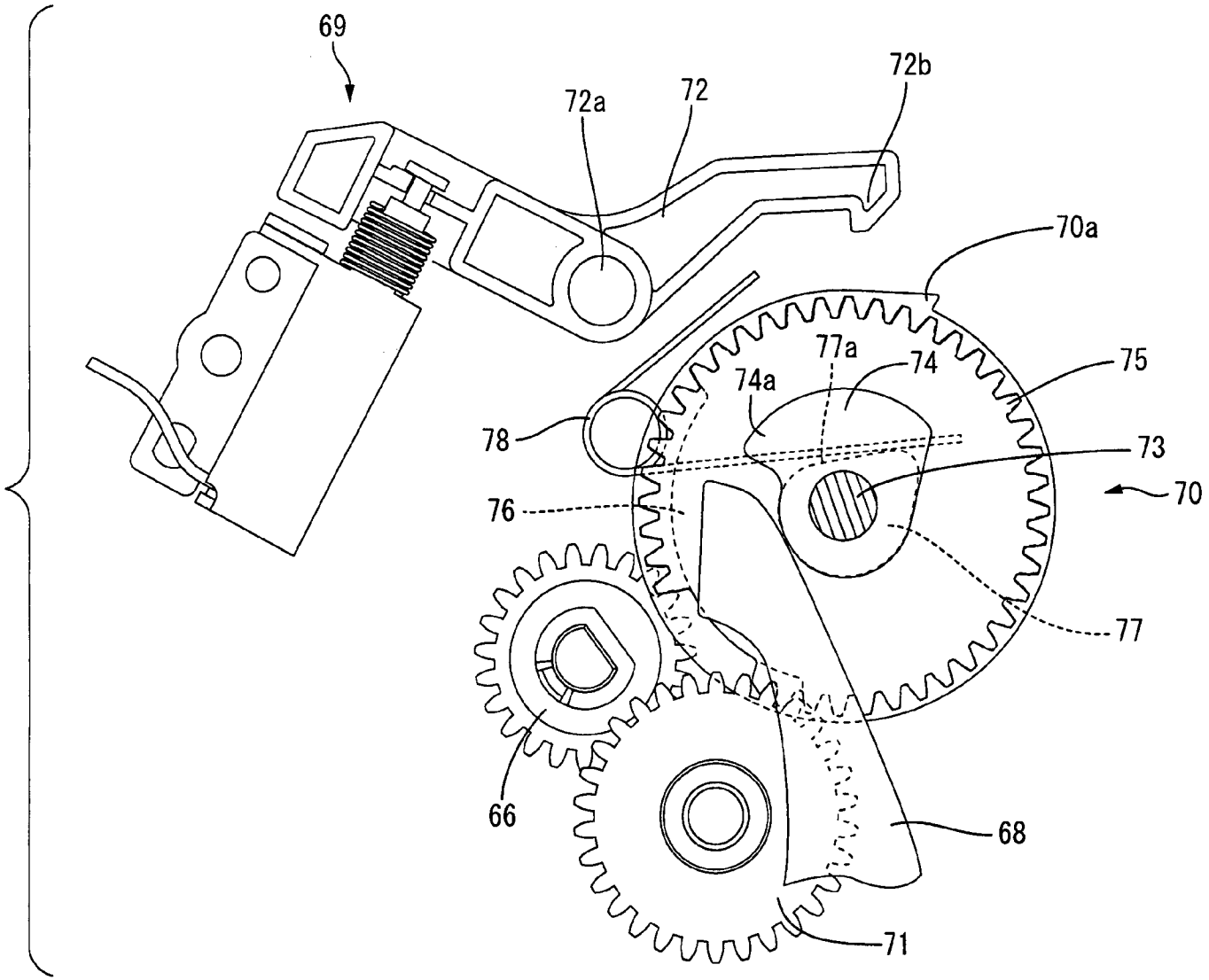
FIG. 7 is a side view of the vertical movement drive mechanism in the state where the MP feed roller lies at its descent position.

FIGS. 4 and 5 are perspective views showing a vertical movement drive mechanism 60 (a drive mechanism) of the MP feed roller 51. In each of these figures, the left upper side of the drawing is the front side of the laser printer 1, the right downward direction of the drawing is the conveyance direction of the paper sheet 3, the right side of the drawing is the left side of the laser printer 1, and the left side of the drawing is the right side of the laser printer 1. Besides, FIGS. 6 and 7 are left side views of the vertical movement drive mechanism. In each of these figures, the right side of the drawing is the front side of the laser printer 1, and the left direction of the drawing is the conveyance direction of the paper sheet 3.

As shown in FIGS. 4 and 5, the roller unit 56 is so configured that the MP feed roller 51 and the MP separation roller 52 are rotatably mounted in a common bearing member 61. Specifically, the MP feed roller 51 is coaxially and unitarily provided with a gear 62 on its side (the left side, and the right side of the drawing in each of the figures), and the constituents 51 and 62 are rotatably supported by a shaft on the front end side of the bearing member 61. The MP separation roller 52 is also coaxially and unitarily provided with a gear 63 on its side (the left side), and the constituents 52 and 63 are rotatably supported by a shaft on the rear end side of the bearing member 61. Besides, the gears 62 and 63 are connected through an intermediate gear 64.

A rotary shaft member 65 extending in the right-and-left direction is arranged coaxially with the MP separation roller 52 on the left side of the MP separation roller 52. A rotary shaft of the MP separation roller 52 is fixed to the right end part of the rotary shaft member 65, while a separation roller drive gear 66 is fixed to the left end part of the rotary shaft member 65. Thus, a drive force from a driving motor not shown is exerted on the separation roller drive gear 66, whereby the MP separation roller 52 is rotated, and the MP feed roller 51 is consequently rotated in driven fashion. Besides, the roller unit 56 is so configured that the side of the MP feed roller 51 is swingable about the MP separation roller 52.

A support arm 67 is arranged so as to extend along the right-and-left direction of the laser printer 1, above the rotary shaft member 65. The support arm 67 is disposed so as to be rotatable about a rotary shaft (not shown) extending along a vertical direction at its middle position. In addition, a penetrating hole 67*a* which vertically penetrates through the support arm 67 is formed on the side of one side end part (the side of the right end part) of this support arm 67. A protrusion

61*a*, which is protruded on the rear end side of the upper surface of the bearing member 61, is inserted in the penetrating hole 67*a*.

A pressing member 68 is disposed behind the side of the other end part (the side of the left end part) of the support arm 67, in such a manner that an upper end part of the pressing member 68 is tiltable about its lower end part. Further, as shown in FIG. 4, the pressing member 68 abuts on the left end part of the support arm 67 with an upper end part of the pressing member 68 located at a front position. The pressing member 68 presses the support arm 67 frontward. On this occasion, the right end part of the support arm 67 presses the protrusion 61*a* rearwards, whereby the MP feed roller 51 lies at its ascent position, which is spaced from the upper surface of the partition member 55 (refer also to FIG. 2).

In contrast, in a state where the upper end part of the pressing member 68 is located at a rear position as shown in FIG. 5, the upper end part comes away from the left end part of the support arm 67. Thus, the rearward pressing on the protrusion 61*a* by the right end part of the support arm 67 is released, and the MP feed roller 51 is moved by its own weight to its descent position at which it is abuttable on the upper surface of the partition member 55, so that the paper feed of the paper sheet 3 is permitted. In this aspect, the MP feed roller 51 is at the same height as the MP separation roller 52 when the MP feed roller 51 is at the uppermost position (ascent position), as shown in FIG. 2. The MP feed roller 51 becomes lower than the MP separation roller 52 in a state where the MP separate roller 52 lies at the descent position.

Arranged in the vicinity of the pressing member 68 are a solenoid switch 69, a sector gear 70, and an input gear 71 that is rotated by receiving a drive force from a driving motor (not shown).

The solenoid switch 69 functions as a switch unit which performs an ON operation each time a feed start signal is received. A solenoid lever 72 has its substantially middle position 72*a* supported so as to be rotatable, and its front end part is lowered down by the ON operation of the solenoid switch 69. Besides, the rear end part of the solenoid lever 72 is unitarily provided with an engagement pawl 72*b*, which engages an engagement protrusion 70*a* protruded on the outer peripheral surface of the sector gear 70.

The sector gear 70 includes a first cam 74 (a cam), a first lacked-tooth gear 75, a second lacked-tooth gear 76 and a second cam 77, which are rotated integrally with an identical rotary shaft 73.

(a) First Lacked-Tooth Gear

More specifically, as shown in FIG. 6, the first lacked-tooth gear 75 has a part lacking teeth. The first lacked-tooth gear 75 is driven and rotated by meshing with the input gear 71 to which the drive force from the driving motor is inputted. Here, adjustments are made so that, when the engagement pawl 72*b* of the solenoid lever 72 and the engagement protrusion 70*a* of the sector gear 70 are in engagement, the lacked-tooth part of the first lacked-tooth gear 75 opposes the input gear 71. That is, on this occasion, the drive force from the input gear 71 is not transmitted to the sector gear 70 (refer to FIGS. 4 and 6).

(b) Second Lacked-Tooth Gear

The second lacked-tooth gear 76 is arranged on the left side of the first lacked-tooth gear 75 (in the right upper direction of the drawing in each of FIGS. 4 and 5, and in the far direction of the drawing in each of FIGS. 6 and 7). The teeth of the second lacked-tooth gear 76 are lacking over a range of substantially one-third of its whole circumstance. The second lacked-tooth gear 76 functions to drive and rotate the MP separation roller 52, by meshing with the separation roller drive gear 66. In the state of FIGS. 4 and 6, the second lacked-tooth gear 76 has not meshed with the separation roller drive gear 66 yet, and the MP separation roller 52 is idly rotatable.

(c) Second Cam

The second cam 77 is arranged on the left side of the second lacked-tooth gear 76 (the right upper direction of the drawing in each of FIGS. 4 and 5, and the far side of the drawing in each of FIGS. 6 and 7). The second cam 77 has a section orthogonal to the rotary shaft 73 that is substantially in the shape of letter D as a whole. One end part of the flat part 77*a* of this second cam 77 forms a protruded large-diameter part 77*b*. A sector spring 78 is disposed in the vicinity of the second cam 77. The sector spring 78 touches the large-diameter part 77*b* of the second cam 77 in a pressed condition in the state shown in FIG. 6. When the engagement by the solenoid lever 72 is released by the ON operation of the solenoids witch 69, the sector spring 78 functions to forcibly rotate the second cam 77 in a clockwise direction in FIG. 6 and turns the sector gear 70 to a position at which the first lacked-tooth gear 75 and the input gear 71 mesh with each other.

(d) First Cam

The first cam 74 is arranged on the right side of the first lacked-tooth gear 75 (the left lower direction of the drawing in each of FIGS. 4 and 5, and the near side of the drawing in each of FIGS. 6 and 7). The first cam 74 has a large-diameter part 74*a* that is enlarged over a range about one-third of its whole circumference. With respect to FIGS. 6 and 7, the upper end part of the pressing member 68 is arranged at the near side of the first cam 74. In the state of FIGS. 4 and 6, the large-diameter part 74*a* of the first cam 74 abuts on the upper end part of the pressing member 68 and holds this upper end part at the front position thereof.

Next, the operation of the vertical movement drive mechanism 60 of the MP feed roller 51 will be described. Before the feed start signal is applied to the solenoid switch 69, this vertical movement drive mechanism 60 assumes a home position as shown in FIGS. 4 and 6. That is, the MP feed roller 51 lies at the ascent position spaced from the paper sheet 3, and the MP separation roller 52 is in the idly rotatable state without being given the drive force.

When the feed start signal is applied to the solenoid switch 69 (outset of the feed-in operation of the sheet member), the engagement between the engagement protrusion 70*a* and the engagement pawl 72*b* is released as shown in FIGS. 5 and 7, so that the sector gear 70 is turned by the urging force of the sector spring 78 to the position at which the first lacked-tooth gear 75 and the input gear 71 mesh with each other. Thus, the sector gear 70 is driven and rotated clockwise in FIG. 7. On this occasion, the large-diameter part 74*a* of the first cam 74 retreats rearwards, and the engagement of the pressing member 68 is released, so that the MP feed roller 51 is moved by its own weight to the descent position at which it abuts on the upper surface of the paper sheet 3 lying on the upper surface of the partition member 55 (refer to FIG. 5). However, the second lacked-tooth gear 76 and the separation roller drive gear 66 do not mesh with each other yet, and the MP separation roller 52 is idly rotatable.

Thereafter, the sector gear 70 is rotated still further, whereby the second lacked-tooth gear 76 and the separation roller drive gear 66 mesh with each other, so that the MP separation roller 52 is driven to rotate. Consequently the MP feed roller 51 is driven. Thus, the paper feed of the paper sheets 3 on the MP tray 41 is started, and these paper sheets 3 are separated one by one at the opposition position Y between the MP separation roller 52 and the MP separation pad 53, so that the separated paper sheet 3 passes through the second conveyance path 54.

When the sector gear 70 is rotated to the position at which the large-diameter part 74*a* of the first cam 74 abuts on the upper end part of the pressing member 68 again, the left end part of the support arm 67 is gradually pressed against the front side by the pressing member 68 until the MP feed roller 51 is reset to the ascent position. On this occasion, the second lacked-tooth gear 76 and the separation roller drive gear 66 still mesh with each other, and the MP separation roller 52 and the MP feed roller 51 are driven to rotate. Here, the circumferential length of the large-diameter part 74*a* of the first cam 74 is adjusted so that the MP feed roller 51 is reset to the ascent position at a time before the rear end of the separated paper sheet 3 passes through the opposition position Y. Especially in this aspect, the timing is set on the basis of the length in the conveyance direction, of the paper sheet of the smallest size for use in the laser printer 1 (for example, the length of the shorter side of a postal card).

(4) Paper-Sheet Presence/Absence Sensor

Figure 8A:
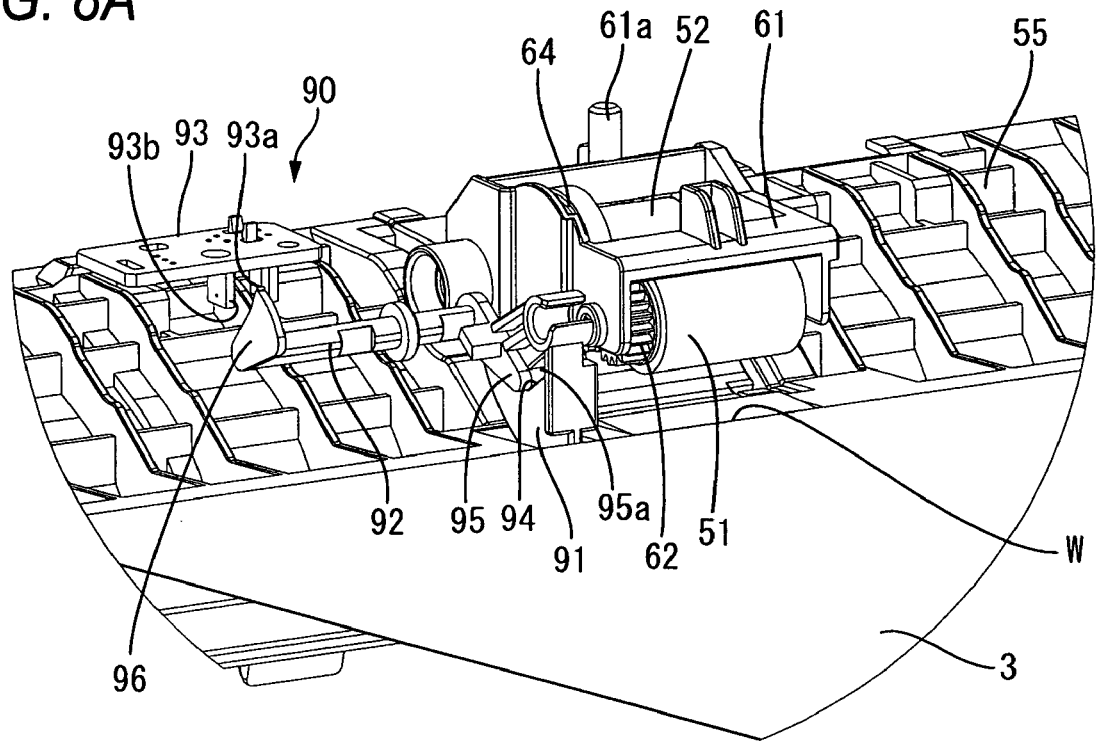
FIGS. 8A and 8B are perspective views showing a sheet presence/absence sensor.
Figure 8B:
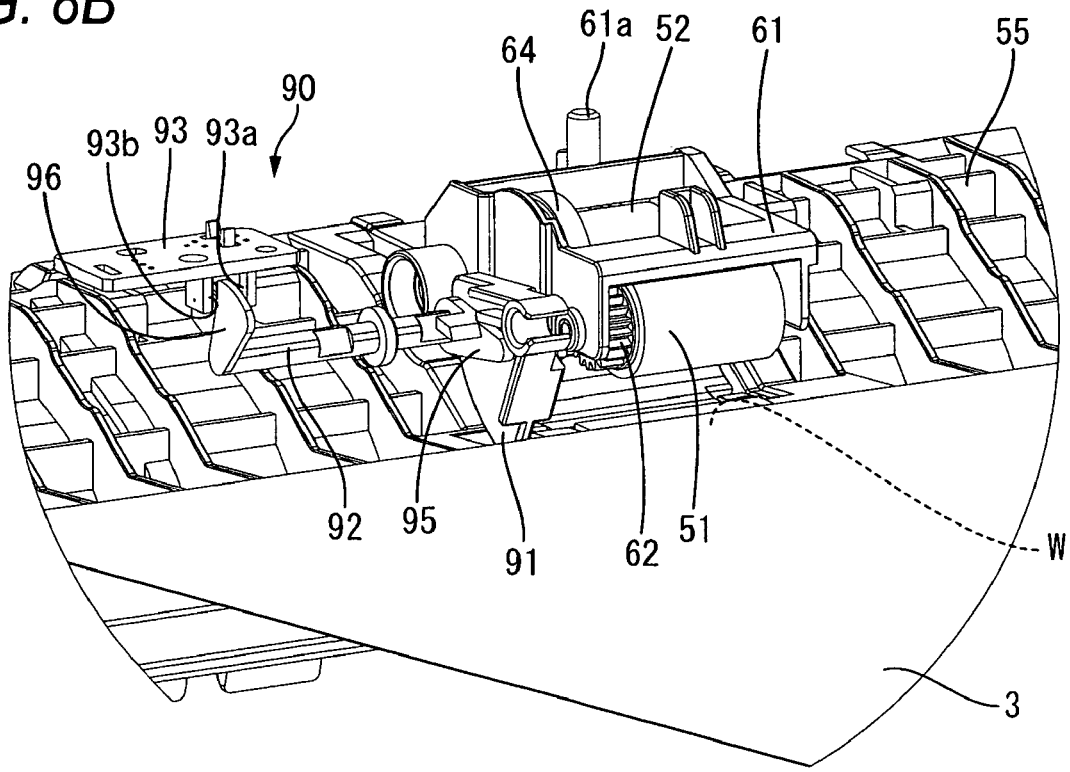

FIGS. 8A and 8B are perspective views showing a paper-sheet presence/absence sensor 90. In these figures, the right lower side of the drawing is the front side of the laser printer 1, and the left upper direction of the drawing is the conveyance direction of the paper sheet 3.

The paper-sheet presence/absence sensor 90 detects the presence or absence of the paper sheet 3 whose distal end lies on the rear side (downstream side of the conveyance direction) with respect to the lower position of the MP feed roller 51 (the position of this roller 51 opposing to the upper surface of the partition member 55, that is, the position thereof abutting on the paper sheet 3 in the presence of this paper sheet 3).

Specifically, the paper-sheet presence/absence sensor 90 includes a swing member 91, the upper end side of which is supported on a rotary shaft extending along a right-and-left direction and the lower end side of which is made swingable. The sensor also includes a light shield member 92, which is rotatable about a rotary shaft similarly extending along the right-and-left direction (located on the rear side with respect to the rotary shaft of the swing member 91), and a photoelectric sensor 93 of so-called "transmission type".

The swing member 91 is formed with a guide groove 94, which extends from the upper end thereof toward the lower end side thereof. The swing member 91 defines a sectoral shape in a side view, as a whole. The top part of the sectoral member 91 is supported by the rotary shaft. The light shield member 92 defines a rod-like shape extending in the right-and-left direction, as a whole. An arm 95 is provided at one end part of the rod-like member 92 so as to protrude along a radial direction. The distal end 95*a* of the arm 95 is bent at right angles and is then inserted into the guide groove 94 of the swing member 91. The bent part of the distal end 95*a* is movable along the guide groove 94. A light shield plate 96 is provided at the other end part of the light shield member 92 so as to protrude in the radial direction. The protrusion length of the light shield plate 96 from the rotary shaft thereof is made smaller than that of the swing member 91 from the rotary shaft thereof. The photoelectric sensor 93 includes a light projection element 93*a* and a light reception element 93*b*, which are arranged in opposition so as to hold the swing path of the light shield plate 96 therebetween in the right-and-left direction.

Owing to such a configuration, when the paper sheet 3 does not lie at the lower position W of the MP feed roller 51 (the opposition position between the MP feed roller 51 and the upper surface of the partition member 55 or abutment position between the feed-in roller and the sheet member) as shown in FIG. 8A, the swing member 91 hangs down by its own weight, and the light shield member 92 assumes an attitude in which the arm 95 lies at the lowermost end part of the guide groove 94 by the weight of this arm 95 itself. On this occasion, the light shield plate 96 lies out and frontward of the opposition position between the light projection element 93*a* and the light reception element 93*b*, and the photoelectric sensor 93 is in a light input state.

On the other hand, when the distal end of the paper sheet 3 has come onto the downstream side of the conveyance direction of this paper sheet 3 with respect to the lower position W, as shown in FIG. 8B, that is, when the paper sheet 3 has come onto the downstream side of the conveyance direction to the position at which the upper surface of this paper sheet 3 abuts on the MP feed roller 51 lying at the descent position thereof, the front end surface of the swing member 91 is pushed and rotated rearwards by the distal end of the paper sheet 3. Consequently, while the distal end part of the arm 95 is being guided from the lowermost end part of the guide groove 94 to the uppermost end part thereof, the light shield member 92 is rotated, and the light shield plate 96 is moved to the opposition position between the light projection element 93*a* and the light reception element 93*b*, so that the photoelectric sensor 93 falls into a light-shielded state.

3. Attachment/Detachment Passage for Process Cartridge

Figure 9:
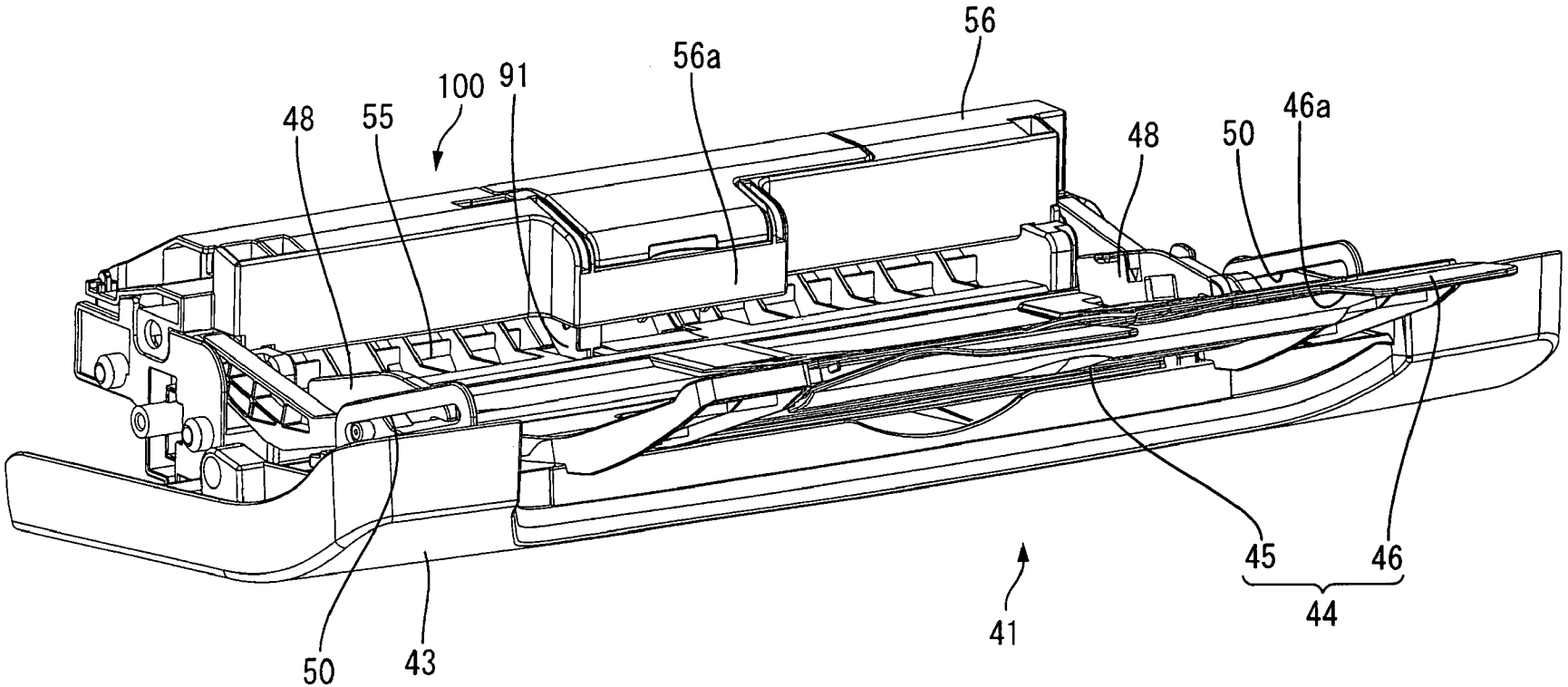
FIG. 9 is a perspective view of a roller unit and the MP tray seen from a front side.
Figure 10:
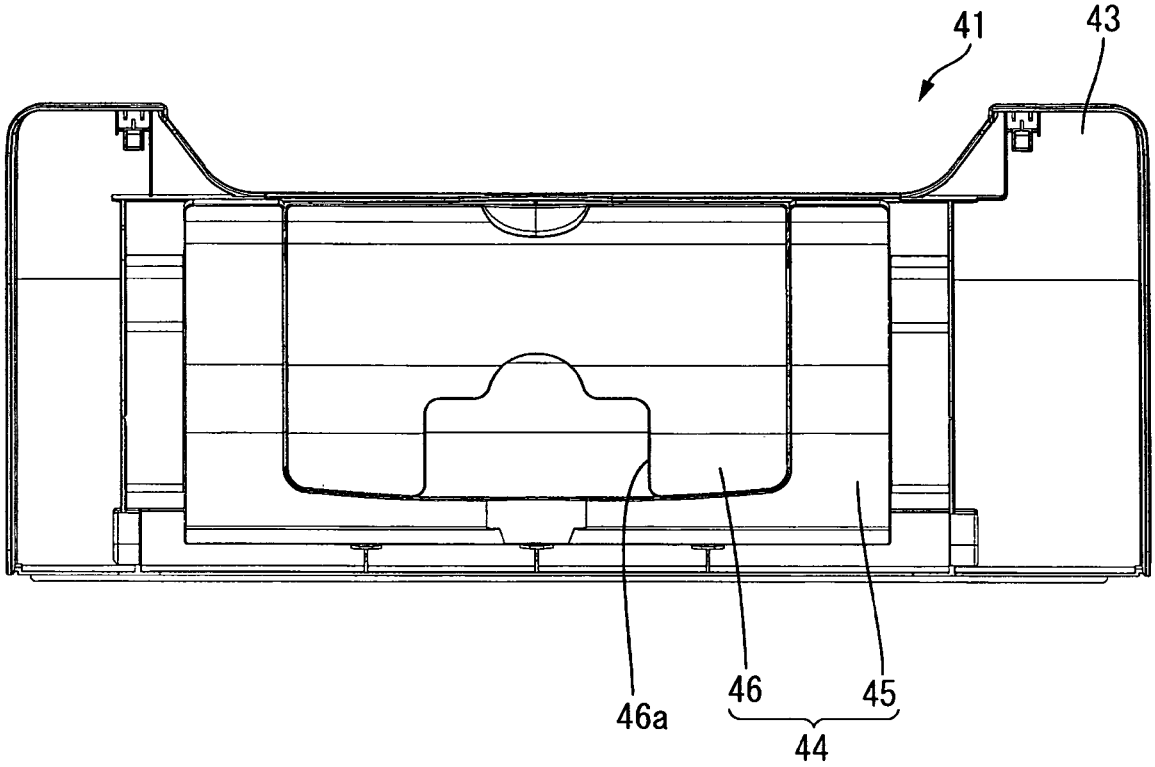
FIG. 10 is a view of a tray portion seen from the rear side, in the state where the MP tray is closed.

FIG. 9 is a perspective view of the roller unit 56 and the MP tray 41 seen from the front side. FIG. 10 is a view of the tray portion 44 seen from the rear side, in the state where the MP tray 41 is closed.

The roller unit 56 defines a shape in which the middle part thereof including the MP feed roller 51, the MP separation roller 52, etc. protrudes frontward. A cut-away part 46*a* is formed in that distal-end middle part of the second tray plate 46, which corresponds to the protrusive part 56*a*. Thus, as shown in FIG. 1, when the MP tray 41 is closed, the protrusive part 56*a* of the roller unit 56 can be received in the cut-away part 46*a*, and the size of the laser printer 1 in the front-and-rear direction thereof can be reduced.

As shown in FIG. 1, the upper surface of the roller unit 56 defines a shape which inclines down rearwards. A space over the inclining upper surface is an attachment/detachment passage 100 which communicates with the attachment/detachment opening 6 of the process cartridge 18.

Figure 11:
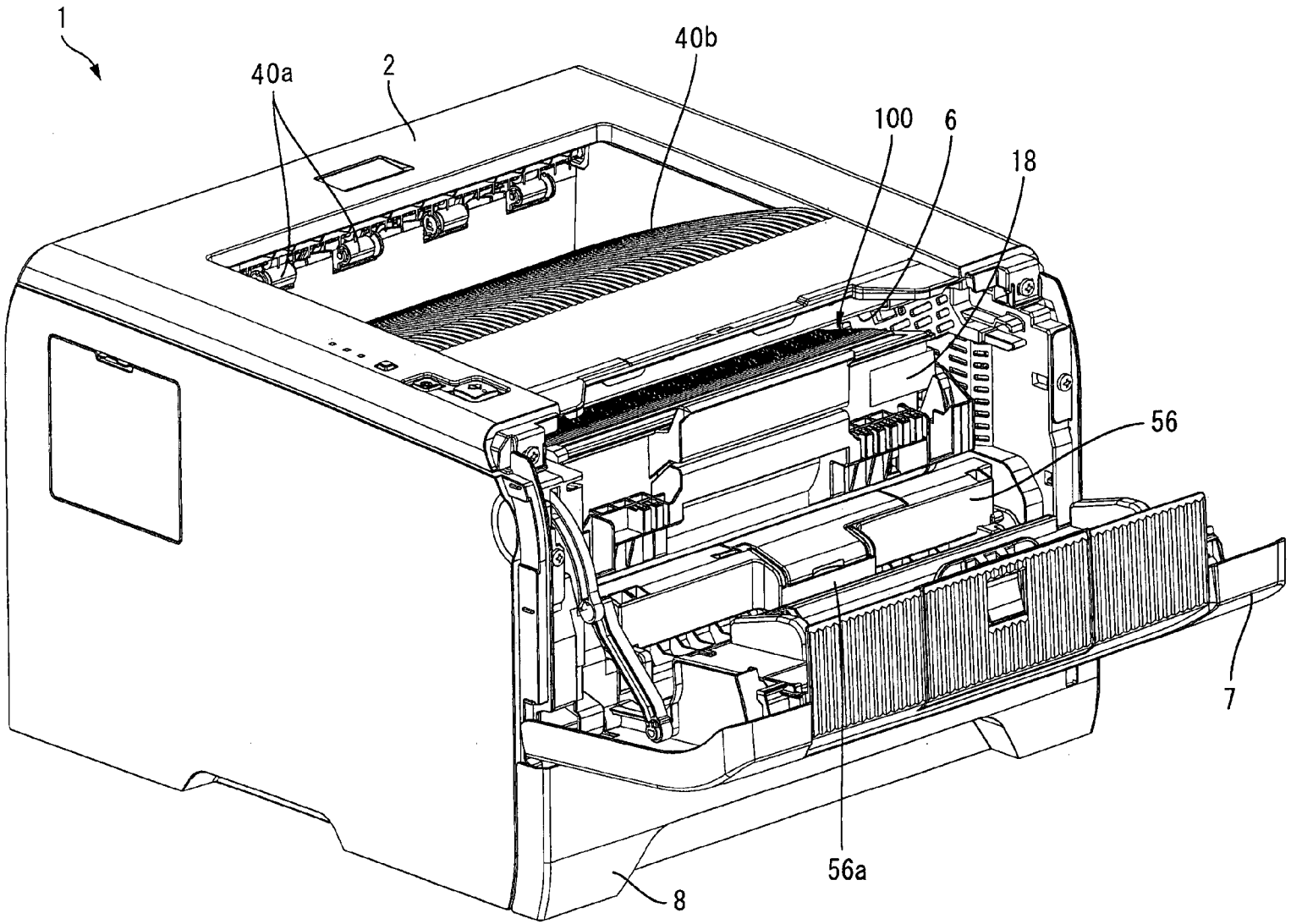
FIG. 11 is a perspective view of the laser printer showing a state where a front cover is opened.
Figure 12:
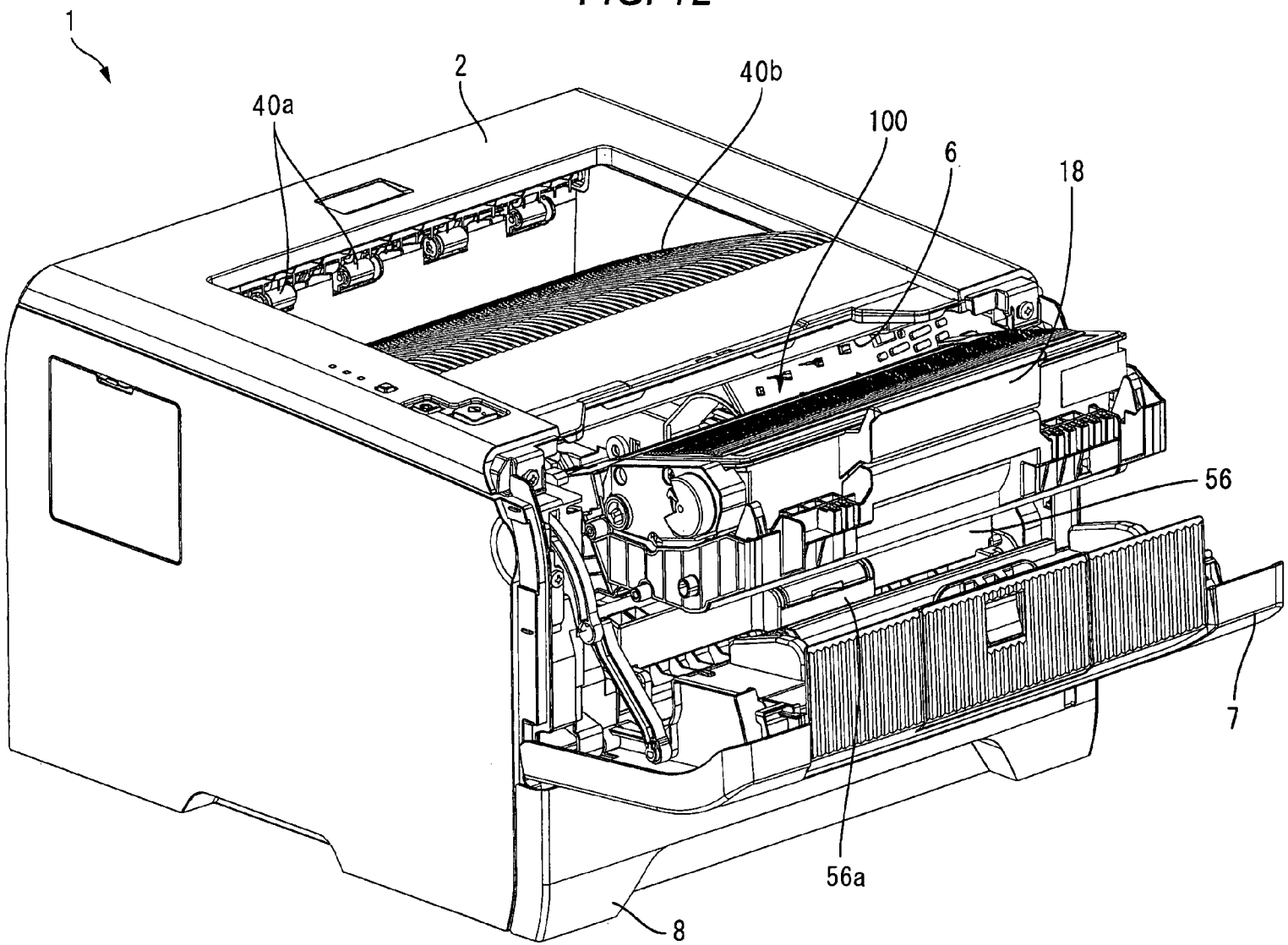
FIG. 12 is a perspective view of the laser printer showing a state where a process cartridge is drawn out.

FIG. 11 is a perspective view of the laser printer 1 showing a state where the front cover 7 is opened. FIG. 12 is a perspective view of the laser printer 1 showing a state where the process cartridge 18 is drawn out.

In the state where the process cartridge 18 is attached to the body casing 2 as shown in FIG. 11, it is arranged so that the lower part of the process cartridge 18 overlaps the roller unit 56 behind this roller unit, as viewed from the front surface side of the laser printer 1. Accordingly, the attachment/detachment passage 100 defines a shape in which the vicinity of the attachment/detachment opening 6 is bulged by the roller unit 56. Therefore, the process cartridge 18 is attached or detached in a manner by lifting the cartridge over the roller unit 56.

In this aspect, as shown in FIGS. 11 and 12, when the front cover 7 is opened, not only the front surface side of the body casing 2, but also the upper front end part thereof is opened. Thus, the process cartridge 18 can be attached or detached by lifting the cartridge over the roller unit 56.

4. Advantages of this Embodiment (1) With the configuration of JP-A-2005-41652 wherein paper feed and separation are performed by one multipurpose feed roller, the multipurpose feed roller of comparatively large diameter needs to be arranged in the vicinity of a multipurpose tray. In contrast, in this aspect, the twin-roller scheme consisting of the MP feed roller 51 and the MP separation roller 52 has been adopted for the multipurpose mechanism. Thus, it has been permitted to adopt rollers that are smaller in diameter than the multipurpose feed roller, as both the rollers 51 and 52. Besides, while the MP feed roller 51 for performing the paper feed has been left in the vicinity of the MP tray 41, the MP separation roller 52 has been arranged on the rear side, and the opposition position Y between the MP separation roller 52 and the MP separation pad 53 has been located between the junction point X and the frontmost part Z.

Thus, the size of the laser printer 1 in the horizontal direction thereof can be reduced to the extent that the MP feed roller 51 for performing the paper feed is smaller in diameter than the multipurpose feed roller in the prior art.

(2) Further, in this aspect, owing to the configuration in which the opposition position Y lies below the junction point X, the size of the laser printer 1 in the vertical direction thereof can also be reduced.

(3) In the configuration of this aspect, the MP feed roller 51 is located by the vertical movement drive mechanism 60 at the descent position allowing the paper sheet 3 to be fed, at the outset of the paper feed operation in which the paper feed start signal has been applied to the solenoid switch 69, and the MP feed roller 51 is thereafter reset to the ascent position before the rear end of the paper sheet 3 passes through the opposition position Y. Accordingly, even in a case, for example, where one remaining paper sheet 3 on the MP tray 41 is to be fed, the rotational drive of the MP feed roller 51 with the abutment thereof on the upper surface of the partition member 55 is avoided, and the burning of the MP feed roller 51 and a heavy load on the vertical movement drive mechanism 60 are preventable. Moreover, since the reset timing of the MP feed roller 51 is set on the basis of the paper sheet 3 of the smallest size usable by the laser printer 1, the above drawbacks are preventable for the paper sheet 3 of any size.

(4) The common rolls 57 are disposed at the distal end part of the partition member 55 on the side of the junction point X, whereby the paper sheet 3 coming via both the first and second conveyance paths 14 and 54 can be guided, and decrease in the number of components, in turn, reduction in the size of the apparatus can be attained.

(5) The vertical movement drive mechanism 60 has the comparatively simple configuration which includes the first cam 74, pressing member 68 and support arm 67, and in which the MP feed roller 51 is moved up and down by the rotation of the first cam 74. Moreover, the first cam 74 is disposed coaxially and unitarily with the second lacked-tooth gear 76 which meshes with the separation roller drive gear 66 for turning the MP separation roller 52 and the MP feed roller 51. Accordingly, the vertical movement timing of the MP feed roller 51 can be easily set by adjusting the circumferential length of the large-diameter part 74*a* of the first cam 74 on the basis of the second lacked-tooth gear 76.

(6) The MP feed roller 51 is moved up and down between the ascent position and the descent position, with the highest position being substantially the same height as that of the MP separation roller 52, within the downwardly inclining space which spreads down frontward from the junction point X, and on this side of the frontmost part Z of the second conveyance path 54. In this manner, the downwardly inclining space is effectively utilized, whereby enlargement in the size of the laser printer 1 in the vertical direction thereof can be suppressed.

(7) Besides, the configuration in which the MP feed roller 51 is driven relative to the MP separation roller 52 is simpler than a configuration in which these rollers are individually driven.

(8) In this aspect, the paper-sheet presence or absence sensor 90 has been configured so as to detect the paper sheet 3 whose distal end lies on the downstream side of the conveyance direction of the paper sheet with respect to the lower position W that is abuttable on the MP feed roller 51 of the descent position. With such a configuration, when the presence of the paper sheet has been detected by the paper-sheet presence or absence sensor 90, the paper sheet 3 exists at the lower position W without fail. It is therefore preventable that, in the absence of the paper sheet 3, the MP feed roller 51 is moved to the descent position to be driven and rotated.

(9) Further, the paper-sheet presence or absence sensor 90 has the configuration in which, in the absence of the paper sheet 3 at the lower position W, the light shield plate 96 brings the photoelectric sensor 93 to the position of the light input state by the weights of the swing member 91 and arm 95 themselves, and in which the swing member 91 is pushed by the paper sheet 3, whereby the light shield plate 96 moves the photoelectric sensor 93 to the position of the light-shielded state. Accordingly, the simple configuration is realized without providing an urging member or the like.

(10) Moreover, the swing member 91 is disposed in the comparatively large region of the front side in the downwardly inclining space, while the light shield plate 96 which is narrower in swing range than the swing member 91 is disposed in the comparatively small region of the rear side, whereby the downwardly inclining space is similarly utilized effectively.

Other Embodiments

The present invention is not restricted to the aspect described above with reference to the drawings, but aspects as stated below by way of example shall be covered within the technical scope of the invention, and the invention can be variously altered and performed within a scope not departing from the purport thereof, otherwise than the following:

(1) In the foregoing aspect, the reset timing of the MP feed roller 51 to the ascent position has been set by the gear control based on the sector gear 70, etc., but this configuration is not restrictive, and the reset timing may well be set by a software control.

(2) The paper-sheet presence or absence sensor 90 has included the photoelectric sensor 93 of transmission type, but a photoelectric sensor of so-called "reflection type" may well be utilized by replacing the light shield plate 96 with a reflection plate. Alternatively, any other detection sensor such as magnetic sensor may well be utilized.

As was described, according to an aspect of the invention, the opposition position between the separation member and the separation roller lies below the junction point.

According to the configuration, the opposition position between the separation member and the separation roller is located below the junction point, whereby the size of the whole image forming apparatus in the vertical direction thereof can also be reduced.

Further, the process unit is attached at a position at which it overlaps the feed-in mechanism behind the feed-in mechanism, as viewed from the side of one side surface; and that an attachment/detachment passage for attaching and detaching the process unit from the housing is formed over the feed-in mechanism.

According to the configuration, the feed-in mechanism is of the twin-roller scheme which consists of the feed-in roller and the separation roller, so that the height of the feed-in mechanism can be made low. Accordingly, even when the attachment/detachment passage for the process unit is provided over the paper feed mechanism, the inclination angle of the attachment/detachment passage in the horizontal direction thereof can be made gentle.

Further, the drive mechanism which moves the feed-in roller up and down is provided; wherein the drive mechanism brings the feed-in roller to a descent position at which the feed-in roller is abuttable on the sheet member at an outset of a feed-in operation for the sheet members on the loading tray, so as to start the feed-in, and it lifts the feed-in roller to an ascent position which is spaced from the sheet members, at a timing before a rear end of the sheet member fed in passes through an abutment position between the sheet member and the feed-in roller.

Also, the timing at which the feed-in roller is lifted is a timing before the rear end of a paper sheet of smallest size as can be loaded on the loading tray passes through the abutment position between the sheet member and the feed-in roller.

With a configuration in which a feed roller is always held at a position where the feed roller abuts on sheet members, in a case, for example, where only one sheet member exists on a loading tray, a feed-in roller might damage in such a manner that the feed-in roller abuts on the opposing member thereof after having fed in the sheet member, and that the feed-in roller is driven and rotated in this condition. With the configuration, the feed-in roller is lifted at the timing before the rear end of the sheet member passes through the abutment position between the sheet member and the feed-in roller. Besides, when the timing at which the feed-in roller is lifted is determined on the basis of the smallest size of the sheet members that can be loaded on the loading tray, the damage of the feed-in roller can be prevented even in case of feeding in sheet members of larger size.

Also, the feed-in roller is moved up and down on this side of a nearest part of the second conveyance passage, as viewed from the side of one side surface.

According to the configuration, the vertical movement range of the feed-in roller can be held wide while enlargement in the size of the image forming apparatus in the vertical direction thereof is suppressed.

Further, the feed-in roller is moved up and down at a position which is lower than the opposition position between the separation member and the separation roller.

According to the configuration, the feed roller is moved up and down at the position which is lower than the opposition position between the separation member and the separation roller, so that a space which is above the opposition position between the separation member and the separation roller need not be ensured for the vertical movement of the feed roller. Incidentally, further reduction in the size of the image forming apparatus in the vertical direction thereof is permitted.

Further, the feed-in roller is disposed so as to be vertically movable about the separation roller, and that it is gear-connected with the separation roller so as to rotate in driven fashion relative to the drive and rotation of the separation roller.

The configuration can be simplified more than a configuration in which the feed-in roller and the separation roller are driven and turned by separate drive sources.

Also, the drive mechanism is configured including a cam which is rotated by receiving a drive force from a driving motor; and a support arm one end part of which is held in engagement with a bearing member for bearing the feed-in roller, and the other end part of which abuts on the cam and moves the feed-in roller up and down with rotation of the cam.

According to the configuration, the drive mechanism which moves the feed-in roller up and down can be incarnated by the simple configuration based on a cam mechanism.

Further, common rolls whose outer peripheral surfaces are exposed to the first conveyance passage and the second conveyance passage and which guide the sheet member passing through both the conveyance passages are rotatably disposed at the junction point between the first and second conveyance passages.

According to the configuration, both the sheet member coming via the first conveyance passage and the sheet member coming via the second conveyance passage can be guided by the common rolls, whereby decrease in the number of components, in turn, reduction in the size of the apparatus can be attained.

Further, a detection mechanism which detects presence or absence of the sheet member on the loading tray is provided; wherein the detection mechanism detects the presence or absence of the sheet member on the loading tray, on the basis of the presence or absence of the sheet member at a position on the downstream side of the conveyance direction of the sheet member with respect to the abutment position between the feed-in roller and the sheet member.

With a configuration in which a detection position by a detection mechanism for detecting the presence or absence of a sheet member on a loading tray is set on this side of the conveyance direction of the sheet member with respect to the abutment position between a feed-in roller and the sheet member, a feed-in operation is started even in a case where the sheet member exists on the loading tray, but the sheet member does not exist at the abutment position between the feed-in roller and the sheet member. Then, the feed-in roller is driven and rotated in direct touch with the opposing member thereof, whereby unfavorably the feed-in roller damages or a large load is exerted on the drive system of the feed-in roller. In the configuration, therefore, the detection position by the detection mechanism is set on the downstream side of the conveyance direction of the sheet member with respect to the abutment position between the feed-in roller and the sheet member. With configuration, in a case where the presence of the sheet member on the loading tray has been detected by the detection mechanism, the sheet member exists at the abutment position thereof on the feed-in roller without fail, and hence, the feed roller can be prevented from being driven and rotated in the absence of the abutting sheet member.

Also, the detection mechanism includes a swing member which is supported by a shaft so as to be swingable about its upper end side, which usually hangs down by its own weight, to a position where its lower end part is abuttable on a front end of the sheet member that is fed in from the sheet member feed-in port, and which retreats from the second conveyance passage when pushed by the sheet member; and a detection unit for detecting the presence or absence of the sheet member on the basis of a swing position of the swing member.

According to the configuration, the swing member is usually in the state where it hangs down by its own weight, it is swung so as to retreat from the second conveyance passage when the lower end part is pushed by the sheet member, and the presence or absence of the sheet member is detected on the basis of the swing position. With the configuration, the detection mechanism can be incarnated by the comparatively simple configuration without providing, for example, an urging member.

Further, the detection unit is configured including a light shield member which is connected with the swing member through an arm on the downstream side of the conveyance direction of the sheet member with respect to the swing member, and which is swung with the swing of the swing member; and an optical type sensor which performs a detection operation on the basis of a light input state and a light-shielded state that change in accordance with a swing position of the light shield member.

The swing member needs to be disposed near the abutment position between the feed-in roller and the sheet member. In the configuration, therefore, the swing member is disposed near the abutment position, while the light shield member and the optical type sensor which constitute the detection unit are disposed on the downstream side of the conveyance direction of the sheet member, whereby enlargement in the size of the vicinity of the feed-in roller is suppressed.

Also, a swinging angle range of the light shield member is narrower than a swinging angle range in which the swing member is swung by being pushed by the sheet member.

According to the configuration, the swinging angle range of the light shield member is made narrow, whereby the size thereof on the downstream side of the conveyance direction of the sheet member is reduced.

Furthermore, the loading tray is disposed so as to be openable and closable between an open attitude in which the sheet members can be loaded and a closed attitude in which the loading tray extends along the side surface of the housing, and that it is formed with a cut-away part at its part which opposes to the feed-in mechanism in the closed attitude.

According to the configuration, in the closed attitude of the loading tray, the feed-in mechanism can be accommodated in the cut-away part, so that reduction in the size of the image forming apparatus in the horizontal direction thereof can be attained.

What is claimed is:

1. An image forming apparatus comprising:

a housing that has a sheet member feed-in port, on a side of one side surface thereof, for feeding in a sheet member;

a loading tray on which the sheet member to be fed into the sheet member feed-in port is loaded;

a sheet member accommodation cassette that is arranged on a bottom side of the housing, a sheet member is accommodated in the sheet member accommodation cassette;

a first conveyance passage formed within the housing, the sheet member accommodated in the sheet member accommodation cassette is conveyed in the first conveyance passage while being folded back from the side of the one side surface of the housing to an opposite side;

a second conveyance passage extending from the sheet member feed-in port to a downstream end side of the first conveyance passage;

a feed-in mechanism disposed in the second conveyance passage, the feed-in mechanism feeding the sheet member from the sheet member feed-in port to a side of a junction point between where the first conveyance passage and the second conveyance passage join; and a process unit that forms an image on the sheet member passed through the junction point, the process unit disposed on a downstream side in a conveyance direction of the sheet member with respect to the junction point;

wherein the feed-in mechanism comprises:

a feed-in roller that feeds the sheet member loaded on the loading tray into the sheet member feed-in port;

a separation member disposed on a downstream side in the conveyance direction of the sheet member with respect to the feed-in-roller; and a separation roller that opposes to the separation member and delivers the sheet member to the side of the junction point;

wherein an opposition position between the separation member and the separation roller is located further from the one side surface than a part of the first conveyance passage and is located closer to the one side surface than the junction point;

wherein the separation member and the separation roller are in contact with each other at the opposition position; and wherein the second conveyance passage inclines upward from the opposition position toward the junction point.

2. The image forming apparatus according to claim 1, wherein the process unit is attached at a position at which the process unit overlaps the feed-in mechanism behind the feed-in mechanism, as viewed from the side of one side surface; and an attachment/detachment passage for attaching and detaching the process unit to and from the housing is formed over the feed-in mechanism.

3. The image forming apparatus according to claim 1, further comprising a drive mechanism that moves the feed-in roller up and down;

wherein the drive mechanism brings the feed-in roller to a descent position at which the feed-in roller is abuttable on the sheet member on the loading tray so as to start feeding, and the drive mechanism lifts the feed-in roller to an ascent position, which is spaced from the sheet member, at a timing before a rear end of the sheet member passes through an abutment position between the sheet member and the feed-in roller.

4. The image forming apparatus according to claim 3, wherein the timing at which the feed-in roller is lifted is a timing before the rear end of a paper sheet of smallest size as can be loaded on the loading tray passes through the abutment position between the sheet member and the feed-in roller.

5. The image forming apparatus according to claim 3, wherein the feed-in roller is moved up and down at a position closer to the one side surface of the housing than the first conveyance passage.

6. The image forming apparatus according to claim 3, wherein the feed-in roller is moved down to a position lower than the opposition position between the separation member and the separation roller.

7. The image forming apparatus according to claim 3, wherein the feed-in roller is vertically movable about the separation roller and is gear-connected with the separation roller to be driven to rotate.

8. The image forming apparatus according to claim 7, wherein the drive mechanism comprises:

a cam that is rotated by receiving a drive force from a driving motor; and a support arm having one end part held by a bearing member for the feed-in roller and having another end part which abuts the cam and moves the feed-in roller up and down with rotation of the cam.

9. The image forming apparatus according to claim 1, further comprising a common roll whose outer peripheral surface is exposed to the first conveyance passage and the second conveyance passage, the common roll guiding the sheet member passing through each of the first conveyance passage and the second conveyance passage and rotatably disposed at the junction point.

10. The image forming apparatus according to claim 1, further comprising a detection mechanism that detects presence or absence of the sheet member on the loading tray;

wherein the detection mechanism detects the presence or absence of the sheet member on the loading tray, on the basis of the presence or absence of the sheet member at a position on the downstream side in the conveyance direction of the sheet member with respect to an abutment position between the feed-in roller and the sheet member.

11. The image forming apparatus according to claim 10, wherein the detection mechanism comprises:

a swing member supported by a shaft so as to be swingable about an upper end side thereof, the swing member hanging down by its own weight to a position where its lower end part is abuttable on a front end of the sheet member fed in from the sheet member feed-in port, and the swing member retreating from the second conveyance passage when pushed by the sheet member; and a detection unit that detects the presence or absence of the sheet member on the basis of a swing position of the swing member.

12. The image forming apparatus according to claim 11, wherein the detection unit comprises:

a light shield member connected with the swing member through an arm on the downstream side in the conveyance direction of the sheet member with respect to the swing member, the light shield member is swung with the swing of the swing member; and an optical sensor that performs a detection operation on the basis of a light input state and a light-shielded state in accordance with a swing position of the light shield member.

13. The image forming apparatus according to claim 12, wherein a swinging angle range of the light shield member is narrower than a swinging angle range in which the swing member is swung by being pushed by the sheet member.

14. The image forming apparatus according to claim 1, wherein the loading tray is openable and closable between an open attitude at which the sheet member is loaded and a closed attitude at which the loading tray extends along the one side surface of the housing, and the loading tray is formed with a cut-away part at its part which opposes to the feed-in mechanism in the closed attitude.

* * * * *